United States Patent [19]

Stegmaier et al.

[11] 4,252,667

[45] Feb. 24, 1981

[54] METHOD FOR PLACING RADIOACTIVE WASTES MIXED WITH BITUMEN INTO CONTAINERS

[75] Inventors: Winfried Stegmaier; Wolfgang Kluger, both of Eggenstein-Leopoldshafen; Hellmut Boden, Illingen; Fritz Schneider, Weissach, all of Fed. Rep. of Germany

[73] Assignees: Kernforschungszentrum Karlsruhe GmbH, Karlsruhe; Werner & Pfleiderer, Stuttgart, both of Fed. Rep. of Germany

[21] Appl. No.: 924,731

[22] Filed: Jul. 14, 1978

[30] Foreign Application Priority Data

Jul. 15, 1977 [DE] Fed. Rep. of Germany ..... 2732031

[51] Int. Cl.[2] ..... G21F 9/16; G21F 9/22

[52] U.S. Cl. ..... 252/301.1 W; 23/307; 34/13; 34/66; 34/183; 264/0.5; 264/349; 366/77; 366/85; 366/88; 366/145; 366/149; 422/309; 425/203; 425/208; 425/209

[58] Field of Search ..... 252/301.1 W; 250/506, 250/507; 366/145, 148. 149, 77, 81, 88, 85; 264/0.5, 349; 425/203, 208, 209; 422/309; 23/307; 34/13, 66, 183

[56] References Cited

U.S. PATENT DOCUMENTS

| | | | |
|---|---|---|---|
| 3,700,247 | 10/1972 | Butler et al. | 366/88 |
| 3,716,490 | 2/1973 | Van de Voorde | 252/301.1 W |
| 3,866,669 | 2/1975 | Gardiner | 366/145 |

FOREIGN PATENT DOCUMENTS

| | | | |
|---|---|---|---|
| 2548251 | 4/1977 | Fed. Rep. of Germany | 250/506 |
| 752066 | 7/1969 | Belgium | 252/301.1 W |

*Primary Examiner*—Benjamin R. Padgett
*Assistant Examiner*—Deborah L. Kyle
*Attorney, Agent, or Firm*—Spencer & Kaye

[57] ABSTRACT

A method and device for filling containers with evaporated radioactive waste concentrates that are mixed with bitumen and from which the water has been expelled by creation of temperatures above the boiling point of water, in which the temperature of the waste mixture is substantially reduced below the water expelling temperature immediately before loading the mixture into the containers.

7 Claims, 2 Drawing Figures

METHOD FOR PLACING RADIOACTIVE WASTES MIXED WITH BITUMEN INTO CONTAINERS

BACKGROUND OF THE INVENTION

The present invention relates to a method for storing evaporated radioactive waste concentrates mixed with bitumen where water has been expelled from the wastes by heating to temperatures above the boiling point of water and subsequently filling the mixture into suitable containers, and to a suitable discharge device therefor.

The object of conditioning radioactive concentrates from waste water processing is to bring the end product into a storable, i.e. a water insoluble, form. In addition to mixing the wastes with cement, a fixing process employs the much more advantageous embedding of the aqueous concentrates or muds and resins, respectively, in hot bitumen.

In this bituminization process the muds or concentrates are introduced into bitumen above 140° C. by means of a multiple shaft extruder in which the water evaporates and the radioactive salts are mixed with the bitumen. The mixture of bitumen and waste leaves the worm shaft extruder under its own gravity force through an open channel into an available drum or waste container. The extruder acts as the evaporator and the mixture is at a temperature of 160°–170° when it leaves the extruder. Due to the low viscosity required, the temperature must be correspondingly high.

The particular drawback of this arrangement is that the bitumen-waste mixture is exposed to the atmosphere while at a high temperature, which involves great danger of combustion. The open discharge channel may also easily become clogged since the stream of bitumen and waste does not flow homogeneously and uniformly. This then requires intensive monitoring of the filling process.

SUMMARY OF THE INVENTION

It is therefore an object of the present invention to provide for safe filling of a bitumen waste mixture from a worm shaft evaporator into drums or barrels.

A more specific object of the invention is to reduce the danger of combustion, created by an open barrel filled with hot bitumen.

A further object of the invention is to reduce the cooling time for the filled drums or barrels.

These and other objects are achieved according to the present invention by a method in which the product temperature of the wastes mixed with bitumen is lowered considerably, compared to the processing temperature immediately before pouring the mixture into the drum or barrel.

The objects of the invention are further achieved by provision of a discharging device provided for this purpose in a multiple worm shaft evaporator, which device is composed of an additional discharge housing attached to the housing of the evaporator to form an extension of the evaporator housing in the conveying direction of the multiple worm shaft extruder, and presenting a conveying bore in which the worm shafts are continued, the underside of the discharge housing being provided with a discharge opening and the walls of the discharge housing being provided with cooling channels.

An advantageous feature of the present invention resides in the provision of heating channels, in addition to the cooling channels, in the walls of the discharge housing, the heating channels and the cooling channels being disposed in concentric circles, and in making the conveying direction of the worm shafts or of the ends of the worm shafts, respectively, opposite to the main conveying direction, starting from the inner boundary of the discharge opening.

In this way, it is possible to advantageously lower the temperature and, despite the resulting increase in pressure, to achieve perfect positive discharge of the bitumen as a result of the pressure increase in the last stage. Cooling is advisably associated with the positive discharge or with the increase in pressure, respectively, as a result of the special design of the worm shaft ends, since otherwise there would exist the danger of clogging.

DESCRIPTION OF THE PREFERRED EMBODIMENTS

In a processing procedure of the type to which the invention is applied, water is driven out of the liquid concentrates or waste materials in the processing portion or in the multiple worm shaft evaporator, by creation of temperatures which lie substantially above the boiling point of water. In particular, for the removal of residual percentages of remaining water it is necessary to have a distinct temperature difference between the boiling point of water and the processing temperature in order to achieve economically justifiable drying with regard to residual water content and throughput of the machine. This generally results in a high product temperature for the end product which is poured into the barrels, with the result that long periods are required until the contents of the barrels have cooled by heat radiation.

Figure 1:
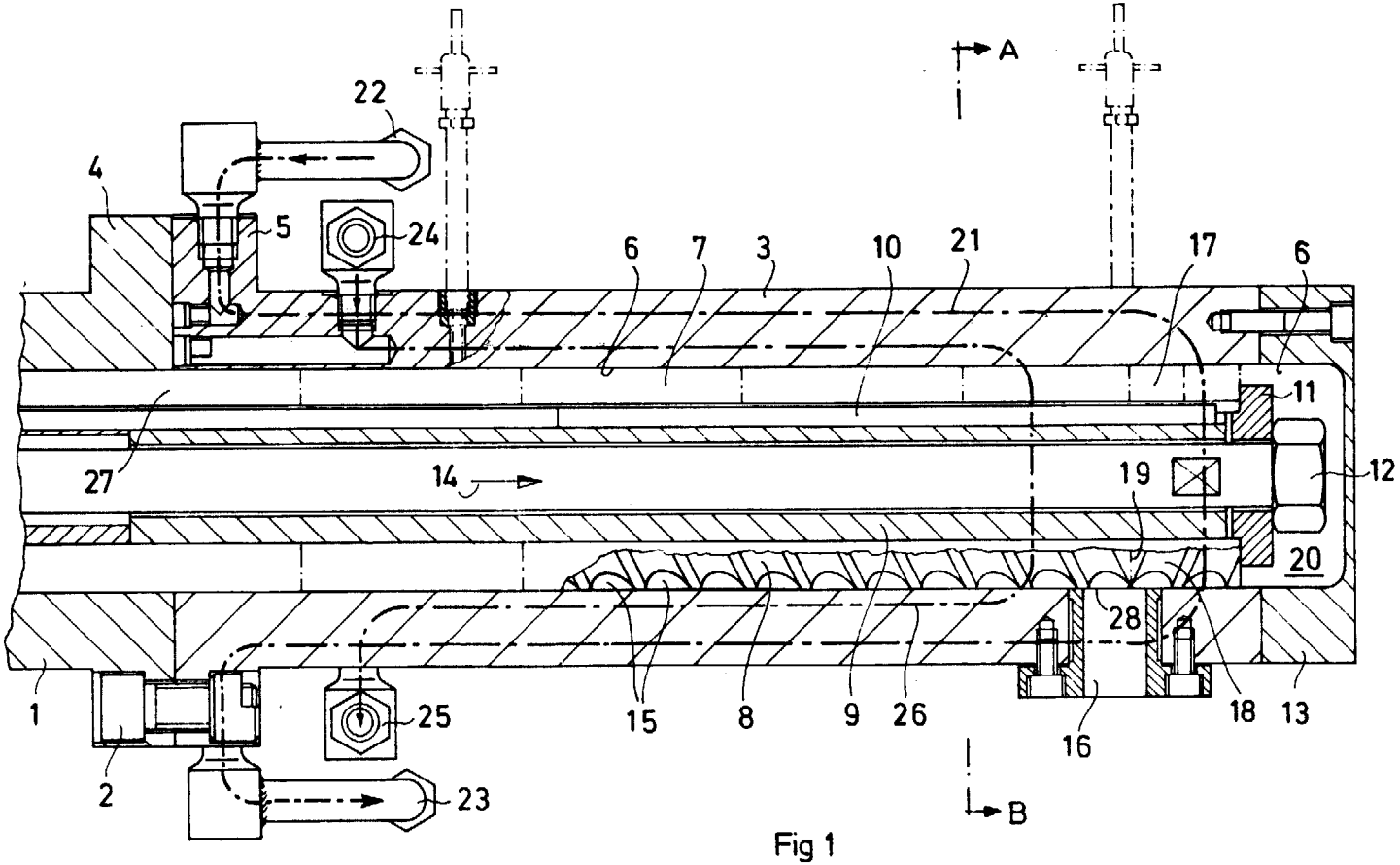
FIG. 1 is a longitudinal, cross-sectional view of the discharge portion of a multiple worm shaft extruder or evaporator, respectively, according to a preferred embodiment of the invention.

Often radioactive products, e.g. ion exchanger resins, are presented for processing which tend to decay under the long-term influence of high temperatures, or which due to their chemical composition tend to undergo chemical reactions at such high temperatures. The advantage offered by the present invention is now that higher temperatures can be permitted in the evaporator or worm shaft extruder, but that immediately before introducing the product into the barrels, its temperature is greatly reduced. FIG. 1 shows the housing 1 of a multiple worm shaft evaporator of known design to which is screwed an additional discharge housing 3 by means of machine screws 2 via respective flanges 4 and 5. Both housings 1 and 3 are divided, at a horizontal plane, (not shown in the drawing) and are provided with two or more juxtaposed, horizontally extending longitudinal bores 6 in which worm shafts 7 act in a known manner. The actual worm shafts 7, whose profile 8 is shown in a broken-away section, are secured against rotation on drive shaft 9 by means of an adjusting spring 10 and are fastened by means of a pressure piece 11 and a bolt 12. At its free end the additional discharge housing 3 is sealed tightly by means of a cover 13.

Figure 2:
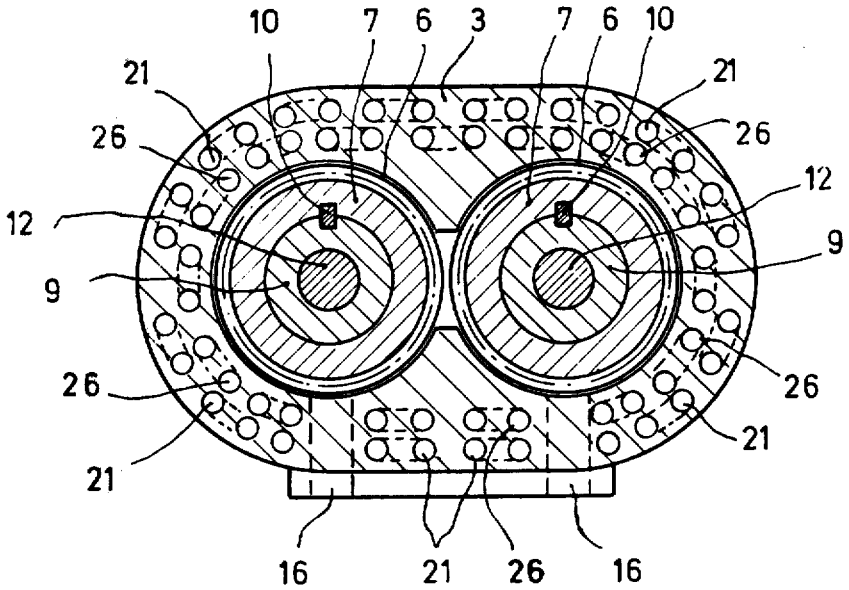
FIG. 2 is a cross-section taken along the line AB of FIG. 1 and shows the precise manner in which the schematically drawn channels of FIG. 1 are arranged along circles in the housing of the worm shaft extruder.

In FIG. 2 is shown how the worm shafts 7 are arranged side by side in the longitudinally bores 6.

Also is shown the manner in which the later mentioned bores 21 and 26 (which are schematically drawn in FIG. 1) are arranged around the bores 6 in the housing 3.

The conveying direction of worm shafts 7 is shown by arrow 14. The bitumen-waste mixture is conveyed in the direction of the arrow 14 through the cavity or the worm channels 15, respectively, of profile 8. A discharge opening 16 with an internal rim, or boundary, 28 is provided at the underside of housing 3 and from the level of this rim 28 the end of the work shaft 17 is of special design. That is, from this point on, the pitch of the turns or helixes 18 of the worm shaft 7 are opposite in direction to those of profile 8 so that beginning at about the plane 19, the conveying direction of the worm becomes opposite to that of arrow 14. Thus an increase in pressure or a return movement is provided in housing bore 6 toward the end 17 of the worm shaft 7 which causes the end of the worm shaft including parts 11 and 12 as well as the end chamber 20 to be kept substantially free of the bitumen mixture and, on the other hand, this mixture to be pressed out of opening 16, or positively discharged, respectively.

This is necessary, particularly because the housing 3 is cooled with cooling water flowing through a circuit 21 between connections 22 and 23. In addition there is provided in housing 3 a heating circuit 26 to effect evaporation and which is supplied via terminals 24 and 25 so as to aid start-up of the worm shafts after they had been stopped and cooled. The two circuits 21 and 26 are advantageously disposed on concentric circles in housing 3.

The system is operated in such a manner that the bitumen-waste mixture enters the additional discharge housing 3 at a temperature of 160°-170° C. approximately at region 27, while being conveyed in the turns 15 of the worm shaft 7 in the direction of arrow 14. In housing 3 it is conveyed while being cooled by means of cooling circuit 21 until it reaches the level of the discharge opening 16 from where it is pressed by the increase in pressure in the end region of the worm shaft despite its greater viscosity as a result of the cooling and drops down into a waste barrel (not shown).

While in the prior art methods the bitumen-waste mixture had to leave the worm shaft evaporator at a high temperature due to the low viscosities required for flow, this is no longer necessary for the positive discharge proposed by the present invention. The axial thrust produced in discharge housing 3 by means of the conveying worms can be so high that the bitumen-waste mixture can have a substantially higher viscosity and thus its temperature can be lower by 60°-100° C.

This reduction in temperature is achieved by flow of the cooling water in cooling circuit 21 through the discharge housing.

Thus the mixture can be cooled from the temperature of 160° C. to 170° C. required for mixing with bitumen to a discharge temperature of the order of 60° to 110° C., for example about 60° C., and the bitumen mixture leaves the worm shaft evaporator at a selectable low temperature. Thus the combustion risk is lowered considerably, as is the period of cooling in the barrels as well. The positive discharge directly into the drums eliminates accumulation and clogging in the discharge device.

It will be understood that the above description of the present invention is susceptible to various modifications, changes and adaptations, and the same are intended to be comprehended within the meaning and range of equivalents of the appended claims.

What is claimed is:

1. In a method for loading containers with a mixture of evaporated aqueous radioactive waste concentrates and bitumen, wherein the water content of the waste has been expelled by creation of temperatures of the mixture above the boiling point of water, the improvement comprising substantially reducing the temperature of the waste mixture with respect to the water expelling temperature immediately before loading the mixture into containers.

2. A method as defined in claim 1 wherein said step of substantially reducing the temperature is carried out to bring the waste mixture to a temperature of between 60° and 110° C. before loading the mixture into containers.

3. A method as defined in claim 2 comprising delivering the mixture, subsequent to said step of reducing the temperature, to a container by forcing the mixture through a discharge opening while subjecting the mixture to conveying forces directed toward one another at a location adjacent the inlet end of the discharge opening.

4. A method as defined in claim 1 comprising delivering the mixture, subsequent to said step of reducing the temperature, to a container by forcing the mixture through a discharge opening while subjecting the mixture to conveying forces directed toward one another at a location adjacent the inlet end of the discharge opening.

5. In a device for conveying and drying a mixture of aqueous radioactive waste concentrates and bitumen, wherein the water content of the waste is expelled by raising the temperature of the mixture above the boiling point of water, which device includes a multiple worm shaft evaporator composed of an evaporator housing and a plurality of conveying worm shafts, the improvement comprising a discharge housing attached to said evaporator housing to define conveying bores extending from said evaporator housing in the conveying direction, with said worms extending into said bores, the underside of said discharge housing being provided with a discharge opening for the mixture, and the walls of said discharge housing being provided with cooling channels.

6. An arrangement as defined in claim 5 wherein the walls of said discharge housing are further provided with heating channels, said heating and cooling channels extending along concentric circles.

7. An arrangement as defined in claim 5 wherein said worm shafts are constructed to have a first conveying direction from said evaporator housing to said discharge opening, and a second conveying direction opposite to the first direction in the region of said discharge opening.

* * * * *